United States Patent [19]

Laird

[11] 4,006,277

[45] Feb. 1, 1977

[54] RANDOM LENGTH CUTTER

[75] Inventor: William F. Laird, Kingston, Canada

[73] Assignee: Hartford Fibres Ltd., Kingston, Canada

[22] Filed: May 20, 1975

[21] Appl. No.: 579,137

Related U.S. Application Data

[62] Division of Ser. No. 472,073, May 21, 1974, Pat. No. 3,915,042.

[52] U.S. Cl. ..... 428/224; 19/.6; 19/.62; 428/401

[51] Int. Cl.² ..... D03D 3/00

[58] Field of Search ..... 428/224, 401, 359, 294, 428/369; 83/346, 18, 913, 37; 19/.6, .62

[56] References Cited

UNITED STATES PATENTS

| | | | |
|---|---|---|---|
| 3,321,448 | 5/1967 | Hebeler | 428/359 |
| 3,403,069 | 9/1968 | Benson | 428/401 |
| 3,557,648 | 1/1971 | Coffin | 83/913 |
| 3,759,775 | 9/1973 | Shepard | 428/401 |
| 3,819,462 | 6/1974 | Starr et al. | 428/359 |

*Primary Examiner*—William J. Van Balen

[57] ABSTRACT

A cutter is provided for cutting rope into fibers of varying lengths. A plurality of blades are provided having cutting edges arcuately arranged and facing either inwardly or outwardly. Rope is fed against the cutting edges of the blades, forcing the rope against the cutting edges and through the spaces between them. The planes of the cutting blades diverge from one another, providing an angular blade arrangement such that the spacing between any pair of blades varies along the length of the blade. The cut fibers, having different lengths, are preferably conveyed by a fluid such as air to a collecting chamber.

10 Claims, 5 Drawing Figures

142
139
115
121
141
122
151
S
143
116
130
131
120
F
145
133
132
144
R
L1
L2
L3
117
140
113
112
111
114
110

RANDOM LENGTH CUTTER

This application is a divisional application of Ser. No. 472,073, filed May 21, 1974, that has now issued as U.S. Pat. No. 3,915,042.

BRIEF DESCRIPTION OF THE INVENTION

This invention relates to a random length cutter for cutting rope into a plurality of cut fibers having lengths which vary in accordance with a controlled pattern. More particularly, the invention relates to an apparatus employing a plurality of spaced apart cutting blades in a substantially closed configuration, with the blades facing either inwardly or outwardly. In accordance with this invention, the blades are staggered with respect to each other, so that the cutting edges of any adjacent pair of blades are angularly related to each other in a manner to cut the rope into fibers of varying lengths. The fibers are preferably of staple lengths in the range of about one inch to six inches or even more or less.

RELATED APPLICATION

Further, this application refers to the co-pending application of Laird et al., Ser. No. 413,902, filed Nov. 8, 1973 now U.S. Pat. No. 3,861,257, granted Jan. 21, 1975 and assigned to the assignee hereof. In the aforesaid co-pending application a precision length cutter is described, wherein the blades are arranged circularly with the cutting edges facing inwardly. In accordance with that disclosure, the rope is fed against the inwardly facing cutting edges and is forced outwardly in a manner to cut the rope into precision lengths. Such an arrangement is particularly useful for cutting of extremely short lengths such as flock length fibers, and it is of great advantage in avoiding jamming of the cut flock between the cutting blades. The disclosure of the aforesaid co-pending application of Laird et al., Ser. No. 413,902, filed Nov. 8, 1973 is hereby incorporated by reference herein.

In the apparatus of the aforementioned co-pending application, a system is provided for conveying away the cut fibers, utilizing air ducts driven by a blower. This air also causes mixing of the flock fibers because of the air turbulence in the conveying ducts.

In such an apparatus the cut fibers are all of the same length, and the blades are arranged parallel to each other.

BRIEF DESCRIPTION OF THE PRIOR ART

Rope cutters have heretofore been provided utilizing a plurality of cutting blades which are spaced apart from each other. In one such apparatus, which differs sharply from the apparatus of the aforesaid co-pending application, a cutting reel has been provided wherein a number of replaceable cutting blades are set around the reel circumference with the cutting edges on the outside. The rope passes through a tensioning device before reaching the cutting reel, and the reel is caused to revolve. This builds up a rope band around the cutting reel with the inner layer of the rope band against the cutting edges of the blades. Adjacent the circumference of the cutting reel there is located a pressure roller which is spaced slightly from the cutting edges of the blades. As the rope bands build up between the blades and the pressure roller, the pressure on the rope increases until it becomes so high that the inner layer of rope is cut by the blades.

The cutting edges of the blades, in such a configuration, are parallel to each other. Thus, as to any adjacent pair of blades, the intervening gap is of constant dimension and as a result the cut fibers are of uniform length, regardless of the location along the lengths of the blades at which they are cut. An apparatus of that type is capable of producing a high quality cut staple, the fibers of which are uniform in length. They are necessarily of staple fiber length, since an apparatus of this type has not been capable of producing cut fibers in extremely short lengths, such as flock, because of interference of the blades with each other due to their convergence along the path of the cut fibers.

In the cutters of the prior art, either cutting inwardly or outwardly, it has been considered to be an advantage that the lengths of the cut fibers were uniform. However, it has now been discovered that a blend of cut fibers having superior characteristics can be prepared by deliberately cutting the fibers so that there is considerable variation in the lengths of the cut fibers. It has been discovered that there is a strong analogy to the field of worsted spun yarns, for example sheepgrown fibers which may vary in length, in the worsted system, from 1½ – 5 or 6 inches or longer, and in the woolen system which utilizes combinations of relatively short fibers ranging in length from about 1 – 2½ inches or even slightly longer.

In the woolen system it has been considered advantageous to provide a combination of different fiber lengths. The long fibers, when twisted, lock together and tend to lock the shorter length fibers as well, thus giving a smooth effect in the yarn and a smooth surface in a fabric made of the yarn.

Efforts have been made in the past to combine different lengths of nylon fibers in order to simulate a worsted spun yarn, or to provide fibers which can be blended with fibers of the worsted system. In this manner, it is possible to obtain much better simulation of the worsted system by providing lengths that vary on a comparable scale. Such systems have been devised in the past, having fixed percentages of fibers of different lengths, mixed together. This has been accomplished by making a large quantity of each specific length and then attempting to blend the batches of fibers of different lengths. However, this has been an expensive mixing operation and has not always been successful in producing a truly uniform mixture.

It is accordingly an object of this invention to provide novel apparatus for automatically and continuously providing a uniform mixture of cut fibers of different lengths. Another object is to provide a flock cutter which may be preset to cut fibers having controlled lengths of different magnitudes.

Another object is to provide such an apparatus which produces precisely cut flock, having mixed fiber lengths of exceptionally high quality, with a minimum number of fusions, of miscuts, and of fiber deformation.

Still another object is to provide an apparatus which is capable of producing and extremely thoroughly mixed product of cut staple fibers, which are readily combinable with natural fibers of the worsted system.

Other objects and advantages of this invention, including the ease with which the length ratios of the cut fibers may be varied, and the ease with which the blades of the cutter may be interchanged and replaced, will further appear hereinafter and in the drawings.

DRAWINGS

DETAILED DESCRIPTION OF THE INVENTION

Figure 1:
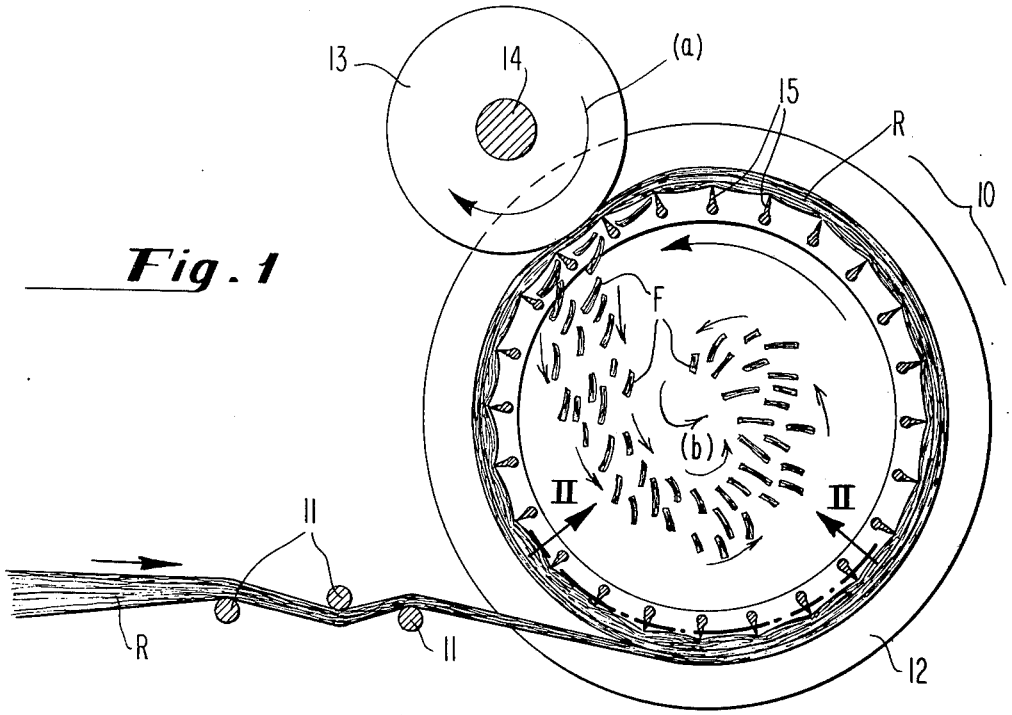
FIG. 1 is a view in side elevation of a flock cutter apparatus constructed in accordance with this invention, with many parts removed in order to reveal important details.

Although this description will utilize specific terms in the interest of clarity, it is to be understood that these terms are used in reference to the specific forms of the invention selected for illustration in the drawings, and are not intended to limit the scope of the invention, which is defined in the appended claims.

As used in connection with this invention the term "rope" is intended to include an elongated bundle of filaments, usually of the synthetic filament type, such as nylon, polyester, etc., arranged substantially parallel to each other and having a reasonably uniform thickness along its length. The filaments of the rope may either be continuous or discontinuous, or may be the same as each other or a blend of different fibers. They may be the same denier or may have different deniers, and may include natural fibers or synthetic fibers alone or blended with each other. Although the most frequently used form of rope is continuous filament tow, this term is also intended to include garnetted waste, piddled filament waste yarns, garnetted sliver filaments and natural fibers, carded sliver, braided or twisted rope and the like. Preferably in accordance with this invention the rope is a tow which may be laid out flat, so that it assumes the shape of a band having a width which is considerably greater than its thickness.

Turning now to FIG. 1 of the drawings, the number 10 comprehensively designates a cutter apparatus for cutting the rope R which is fed continuously from any convenient source, not shown, over and under the flattening rods 11 in a manner to decrease the thickness of the rope while concurrently increasing its width, for a reason which will be described in further detail hereinafter. The number 12 designates a reel which is constructed to be driven in rotation about its center in a continuous manner and at a regulatable velocity of rotation. Located adjacent to the reel 12 is a pressure roller 13 which is rotatable about its axis 14 in the direction indicated by the arrow (*a*) appearing in FIG. 1. Means are provided of a conventional nature, not shown, for pressing the roller 13 against the rope R which is wrapped repeatedly over and upon itself on the reel 12, as shown in FIG. 1.

The number 15 designates a plurality of cutter blades which are spaced apart from one another and arranged with their cutting edges facing radially outwardly. It will be apparent that the pressure of the roller 13, bearing upon the outermost layer of rope R, transmits a pressure through the outer layer of rope R and forces the innermost layer of rope R against the adjacent cutting edges, causing the rope to be cut into staple length fibers F. These staple length cut fibers F are then mixed with one another in the turbulent air within the ring of blades, as indicated by the arrows (*b*) in FIG. 1, thus causing an intimate admixture of the cut fibers. As stated, a conventional air conveying system, not shown in the drawings, is desirably utilized to draw the cut fibers out of the space within the reel 12 and to convey them to a suitable destination such as a fiber collecting bin, for example.

Figure 2:
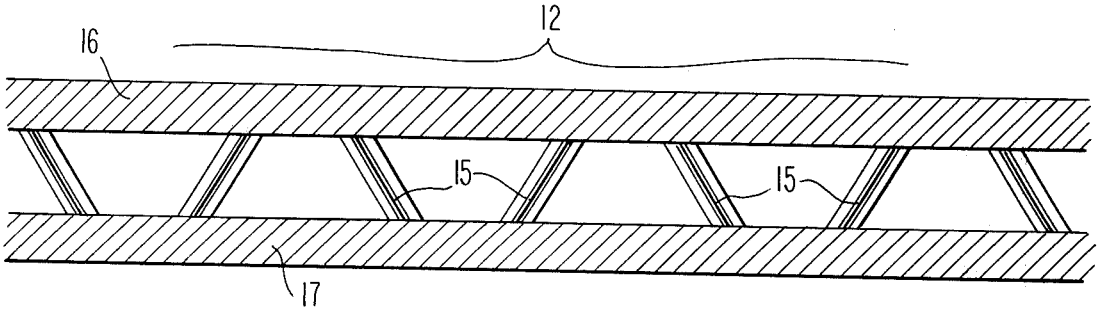
FIG. 2 is a view in section taken as indicated by the lines and arrows II—II which appear in FIG. 1, this sectional view being considerably enlarged as compared to FIG. 1.

FIG. 2 of the drawings shows that the blades 15 are angularly arranged with respect to each other. Specifically, the cutting edges of each adjacent pair of blades are at angles to each other, such that the distance between the cutting edges varies across the path of the rope R. As will be apparent in FIG. 2, the reel 12 includes a pair of blade supporting rings 16, 17 which extend circularly completely around the reel and which constitute the supporting means upon which the blades are mounted. It will be appreciated that the rope R, which has been flattened and widened into a band by the rods 11 appearing in FIG. 1, occupies the entire space between the ring 16 and the ring 17. Similarly, the thickness of the pressure roll 13 is equal to the distance between the rings 16, 17, so that the pressure roll 13 exerts pressure on the rope all the way across the intervening space between the rings 16, 17.

Accordingly, when the reel 12 and the pressure roll 13 are rotated, the pressure roll 13 forces the rope against the staggered edges of the blades 15, cutting them into a substantially infinite variety of different lengths.

Figure 3:
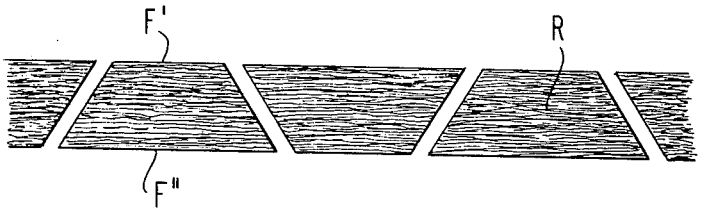
FIG. 3 is a view of the cut fibers themselves, as they appear at the instant of cutting, utilizing a staggered cutting blade arrangement as illustrated in FIG. 2.
Figure 4:
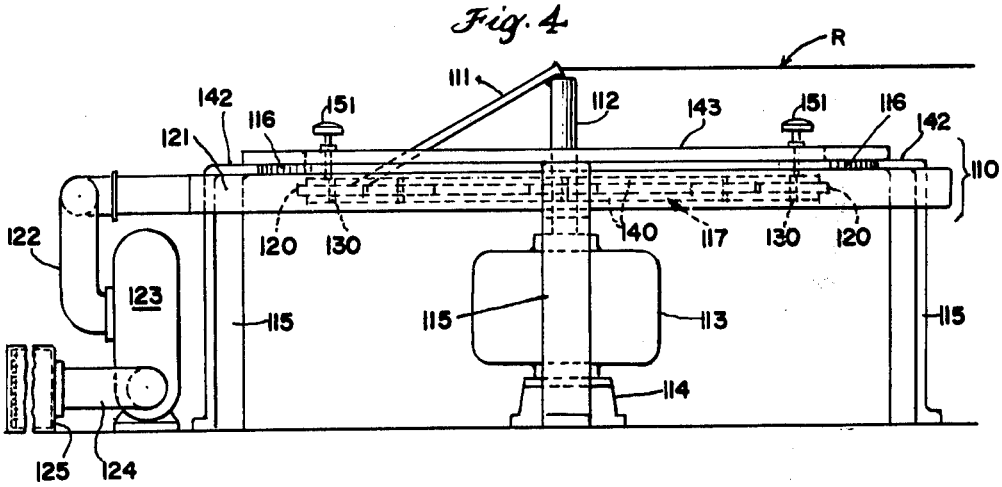
Figure 5:
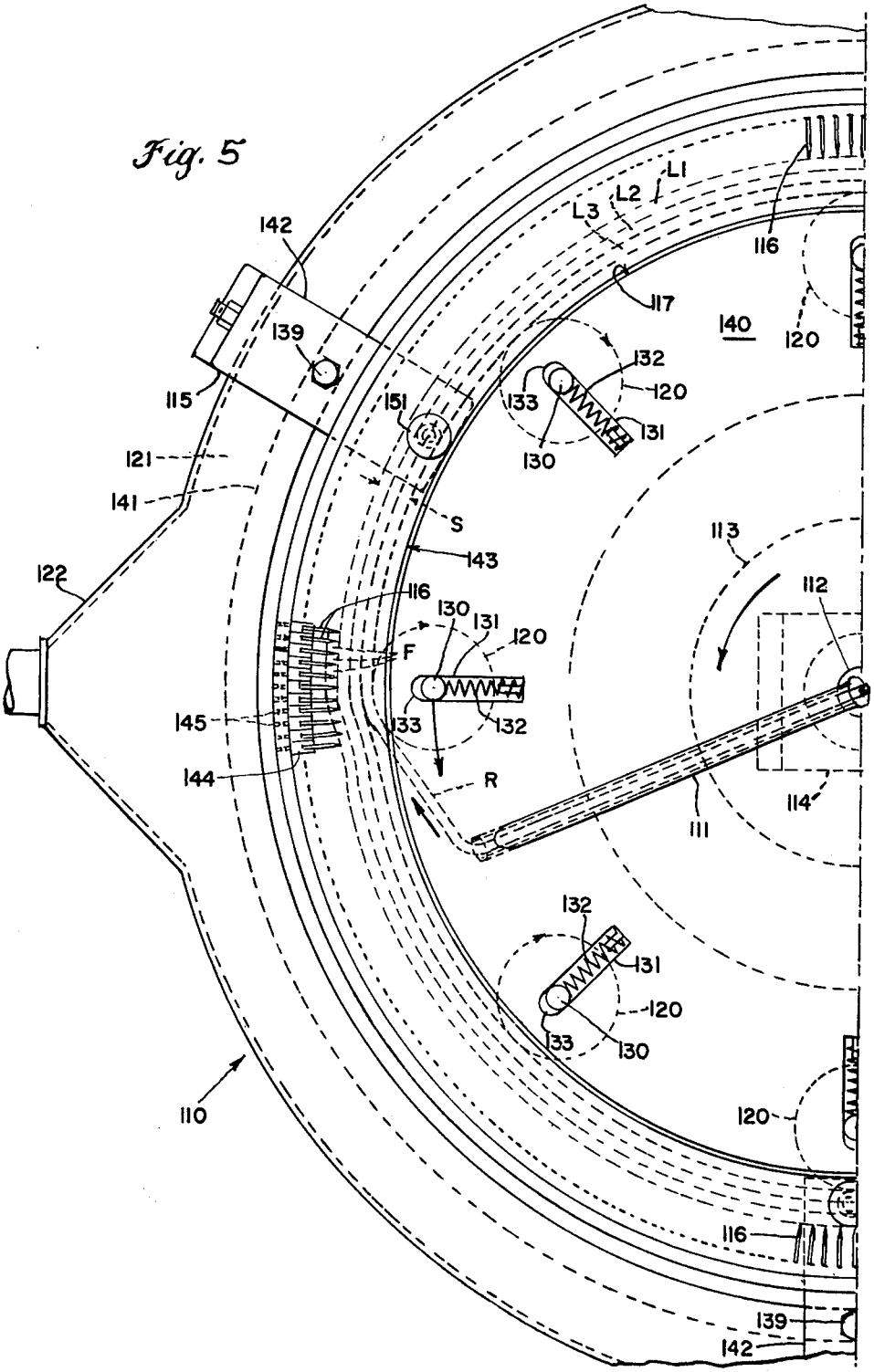

FIG. 3 shows the rope R at the instant of cutting, looking at the rope from the same viewpoint as the blades are viewed in FIG. 2. It will be apparent that each blade cooperates with its adjacent blades to cut the fibers of the rope R angularly, providing a variation of fiber length across the width of the band of rope R. Those fibers F′ which are located where the cutting edges are closest together are the shortest fibers produced by the cutting operation, whereas those fibers F″ which are located where the cutting edges of the blades are farthest apart are the longest fibers produced by the cutting operation. The fibers in between these locations have intermediate lengths.

Of course, the entire reel 10 may be removed as a unit and replaced with another reel. In this manner, adjustments may be made quickly with respect to different spacings between the blades, angular relationships between the blades, different types of blades, etc. Also, if desired, the blades may be individually adjustable upon the reels, if desired. In any event, changing of the reels or adjustment of the blades allows the operator to produce blended cut fibers having different desired ratios of long fibers to short fibers, and to vary the actual lengths of the longest fibers and of the shortest fibers. Similarly, some blades may even be omitted, and it is possible even to vary the distances in a random or predetermined pattern, between the adjacent pairs of blades themselves. In this manner, a wide variety of products may be obtained with certainty.

It is of great advantage in accordance with this invention that the cut fibers are blended with each other in such a manner that the fibers that are adjacent to each other have different lengths at the time the cutting operation is performed. This contributes to the ease of producing a uniform product, since the cut fibers of varying lengths are very easy to blend with each other in the simple process of conveying them away, utilizing turbulent air in an air delivery system.

The number of wraps of uncut rope R that are trained around the cutting edges may be varied at will, and depends of course upon the pressure exerted by the pressure roll 13. However, it is preferred to space the pressure wheel at least far enough away that it cannot damage the cutting edges of the blades. There should normally be at least a partial layer of uncut infeeding rope R in the intervening space between the pressure roll 13 and the arc in which the cutting edges lie.

The rope R, of course, may be of any denier at all. With smaller denier such as 10,000 or less, it is preferable to use a larger number of layers of uncut rope in the intervening space, but with deniers of 250,000 to 500,000 or more, a lesser number of such uncut layers (such as part of one or up to two) is considered more practical.

It will be appreciated that the rope R may be cut while wet, if desired, and the wet cut fibers may be conveyed away either by air or by some other fluid, or even by mechanical means.

Although wide varieties of particular blend cuts may be made, some of those which are considered particularly desirable are 1½ to 3 inches, 2 to 4 inches, 2½ to 5 inches, 3 to 5 inches, 3 to 6 inches and 4 to 6 inches. Further, it is particularly desirable to make a cut blend of 4 to 7½ inches, for production of a bulky but "even" carpet yarn. Although a cut staple of 7½ inches length is in substantial use in the carpet industry, it produces a very lean yarn when spun. Graduated length cut fibers according to this invention produce a vastly superior yarn and a vastly superior carpet product, because the yarn is more bulky and less lean as compared to yarns of the prior art.

Although this invention has been described with reference to certain specific embodiments thereof, it will be appreciated that various modifications may be made, including the substitution of equivalent elements for those shown and described. Further, the invention comprehends the use of certain features independently of other features; for example, it is possible to generate cutting pressure by any means other than the pressure roll 13, and in some cases the rope R has adequate geometry as delivered, and need not be flattened out in the manner illustrated and described in connection with FIG. 1. of the drawings. Further, it is apparent that this invention is fully applicable to a cutter which cuts in the opposite direction to that shown in FIG. 1, namely a cutter having blades which face inwardly and having a pressure means which forces the fiber outwardly for cutting between the blades. Other modifications include the reversal of parts, the substitution of equivalent elements, and other modifications which may be made without departing from the spirit and scope of the invention as defined in the appended claims.

The following is claimed:

1. Uniformly mixed cut staple fibers having lengths which vary substantially infinitely between predetermined maximum and minimum cut lengths wherein the number of fibers of any given length is substantially equal to the number of fibers of any other given length.

2. The staple fibers defined in claim 1, wherein the lengths of the fibers vary between 1½ to 3 inches.

3. The staple fibers defined in claim 1, wherein the lengths of the fibers vary between 2 to 4 inches.

4. The staple fibers defined in claim 1, wherein the lengths of the fibers vary between 2½ to 5 inches.

5. The staple fibers defined in claim 1, wherein the lengths of the fibers vary between 3 to 5 inches.

6. The staple fibers defined in claim 1, wherein the lengths of the fibers vary between 3 to 6 inches.

7. The staple fibers defined in claim 1, wherein the lengths of the fibers vary between 4 to 6 inches.

8. The staple fibers defined in claim 1, wherein the lengths of the fibers vary between 4 to 7½ inches.

9. In a worsted system, uniformly mixed cut staple fibers having lengths which vary substantially infinitely between predetermined maximum and minimum cut lengths formed by forcing a rope against angularly arranged cutting blades and wherein the number of fibers of any given length is substantially equal to the number of fibers of any other given length.

10. A simulated worsted system comprising the combination of uniformly mixed cut staple natural and synthetic fibers having lengths which vary substantially infinitely between predetermined maximum and minimum cut lengths formed by forcing a rope against angularly arranged cutting blades and wherein the number of fibers of any given length is substantially equal to the number of fibers of any other given length.

* * * * *